US011257638B2

(12) United States Patent
Liang et al.

(10) Patent No.: US 11,257,638 B2
(45) Date of Patent: Feb. 22, 2022

(54) KEY STRUCTURE

(71) Applicants: LITE-ON ELECTRONICS (GUANGZHOU) LIMITED, Guangzhou (CN); LITE-ON TECHNOLOGY CORPORATION, Taipei (TW)

(72) Inventors: Hsin-Chih Liang, Taipei (TW); Yi-Wen Chen, Taipei (TW)

(73) Assignees: LITE-ON ELECTRONICS (GUANGZHOU) LIMITED; LITE-ON TECHNOLOGY CORPORATION

( * ) Notice: Subject to any disclaimer, the term of this patent is extended or adjusted under 35 U.S.C. 154(b) by 0 days.

(21) Appl. No.: 16/930,063

(22) Filed: Jul. 15, 2020

(65) Prior Publication Data

US 2021/0020393 A1 Jan. 21, 2021

Related U.S. Application Data

(60) Provisional application No. 62/875,007, filed on Jul. 17, 2019.

(30) Foreign Application Priority Data

Jun. 19, 2020 (CN) ..... 202010566248.X

(51) Int. Cl.

| | |
|---|---|
| ***H01H 13/20*** | (2006.01) |
| ***H01H 13/10*** | (2006.01) |
| ***H01H 13/14*** | (2006.01) |
| ***H01H 13/702*** | (2006.01) |
| ***H01H 13/7073*** | (2006.01) |

(Continued)

(52) U.S. Cl.

CPC ..... *H01H 13/20* (2013.01); *H01H 3/125* (2013.01); *H01H 13/10* (2013.01); *H01H 13/14* (2013.01); *H01H 13/702* (2013.01); *H01H 13/705* (2013.01); *H01H 13/7073* (2013.01);

(Continued)

(58) Field of Classification Search

CPC ..... H01H 13/20; H01H 3/125; H01H 13/705; H01H 13/83; H01H 13/7073; H01H 13/10; H01H 13/14; H01H 13/702; H01H 2219/06; H01H 2233/07; H01H 2215/03; H01H 13/7065; H01H 2219/014; H01H 2219/036; H01H 2219/037; H01H 2219/062;

(Continued)

(56) References Cited

U.S. PATENT DOCUMENTS 8,168,905 B2 * 5/2012 Yang ..... H01H 13/83 200/314
9,633,803 B2 * 4/2017 Wang ..... H01H 13/023

(Continued)

*Primary Examiner* — Lheiren Mae A Caroc
(74) *Attorney, Agent, or Firm* — Innovation Counsel LLP

(57) ABSTRACT

A key structure includes a bottom plate, a keycap, a lifting mechanism, a thin-film switch layer and a backlight module. The bottom plate has a through hole. The lifting mechanism is pivotally connected to the bottom plate and the keycap. The thin-film switch layer has a reflective structure corresponding to the through hole. The backlight module includes a light source and a reflective layer. The light source is configured to emit light towards the reflective structure. The reflective layer is disposed surrounding the light source to reflect a reflected light from the reflective structure to the thin-film switch layer.

14 Claims, 10 Drawing Sheets

(51) Int. Cl.
*H01H 3/12* (2006.01)
*H01H 13/705* (2006.01)
*H01H 13/83* (2006.01)

(52) U.S. Cl.
CPC ..... *H01H 13/83* (2013.01); *H01H 2219/06* (2013.01); *H01H 2233/07* (2013.01)

(58) Field of Classification Search
CPC ..... H01H 3/12; G02F 1/133602; G02F 1/133603; G02F 1/133604; G02F 1/133605
See application file for complete search history.

(56) References Cited

U.S. PATENT DOCUMENTS

| | | | | |
|---|---|---|---|---|
| 10,121,613 | B2 * | 11/2018 | Chen | H01H 13/83 |
| 2010/0147660 | A1 * | 6/2010 | Lin | H01H 3/125 200/314 |
| 2019/0027326 | A1 * | 1/2019 | Tsai | H03K 17/98 |

* cited by examiner

KEY STRUCTURE

This application claims the benefit of US provisional application Ser. No. 62/875,007, filed Jul. 17, 2019, the subject matter of which is incorporated herein by reference, and this application claims the benefit of People's Republic of China application Serial No. 202010566248.X, filed on Jun. 19, 2020, the subject matter of which is incorporated herein by reference.

BACKGROUND OF THE INVENTION

Field of the Invention

The invention relates in general to a structure, and more particularly to a key structure.

Description of the Related Art

The existing light-emitting key structure includes a light source and a keycap. The light source is configured to emit light towards the keycap. The light is outputted via the keycap and illuminates the letters thereon. Since the light source has a small volume and the distance between the light source and the keycap is very tiny, the output light of the light source could only partially irradiate the letters on the keycap. Therefore, it has become a prominent task for the industries to provide a new key structure capable of resolving the existing problems of the prior art.

SUMMARY OF THE INVENTION

The invention is directed to a key structure capable of resolving the existing problems of the prior art.

According to one embodiment of the present invention, a key structure is disclosed. The key structure includes a bottom plate, a keycap, a lifting mechanism, a thin-film switch layer and a backlight module. The bottom plate has a through hole. The lifting mechanism is pivotally connected to the bottom plate and the keycap. The thin-film switch layer has a reflective structure corresponding to the through hole. The backlight module includes a circuit layer, a light source, and a reflective layer. The light source is disposed on the circuit layer and configured to emit light towards the reflective structure. The reflective layer is disposed surrounding the light source to reflect a reflected light from the reflective structure to the thin-film switch layer.

The above and other aspects of the invention will become better understood with regard to the following detailed description of the preferred but non-limiting embodiment (s). The following description is made with reference to the accompanying drawings.

DETAILED DESCRIPTION OF THE INVENTION

Detailed descriptions of the invention are disclosed below in a number of embodiments with accompanying drawings. However, the embodiments are for explanatory and exemplary purposes only, not for limiting the scope of protection of the present invention.

Figure 1A:
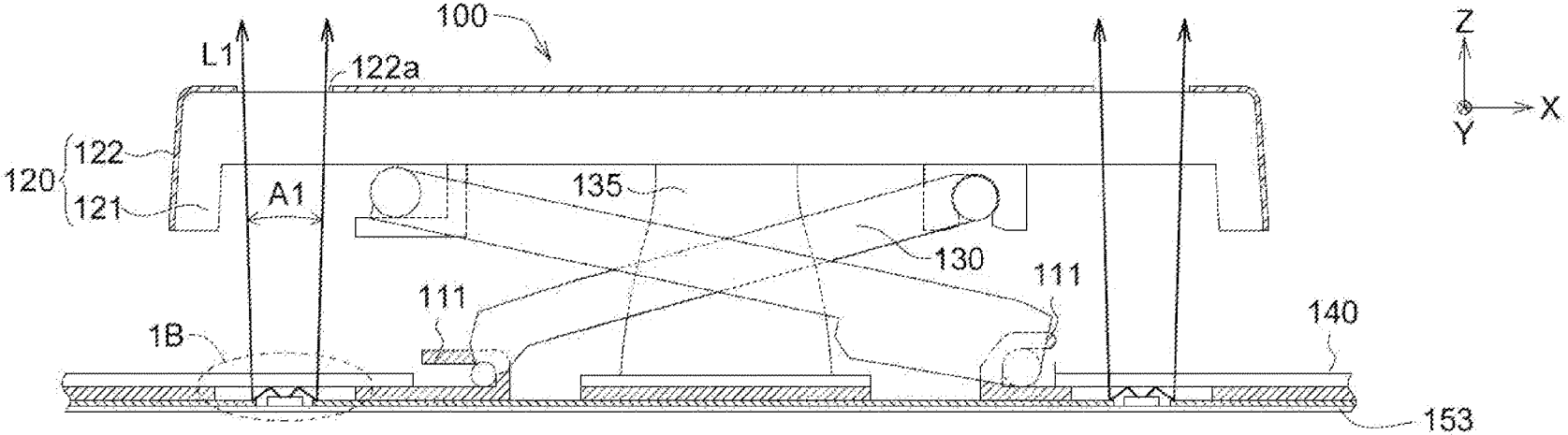
FIG. 1A is a partial cross-sectional view of a key structure according to an embodiment of the present invention.
Figure 1B:
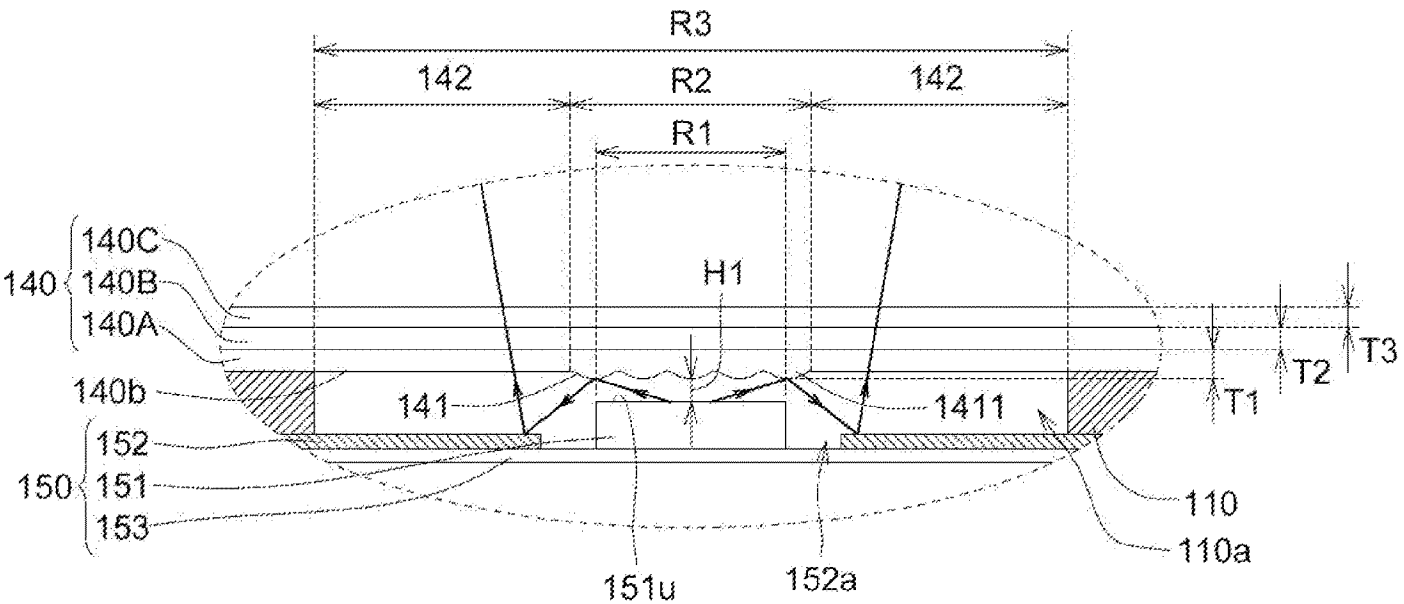
FIG. 1B is an enlarged view of a local portion 1B of FIG. 1A.
Figure 2A:
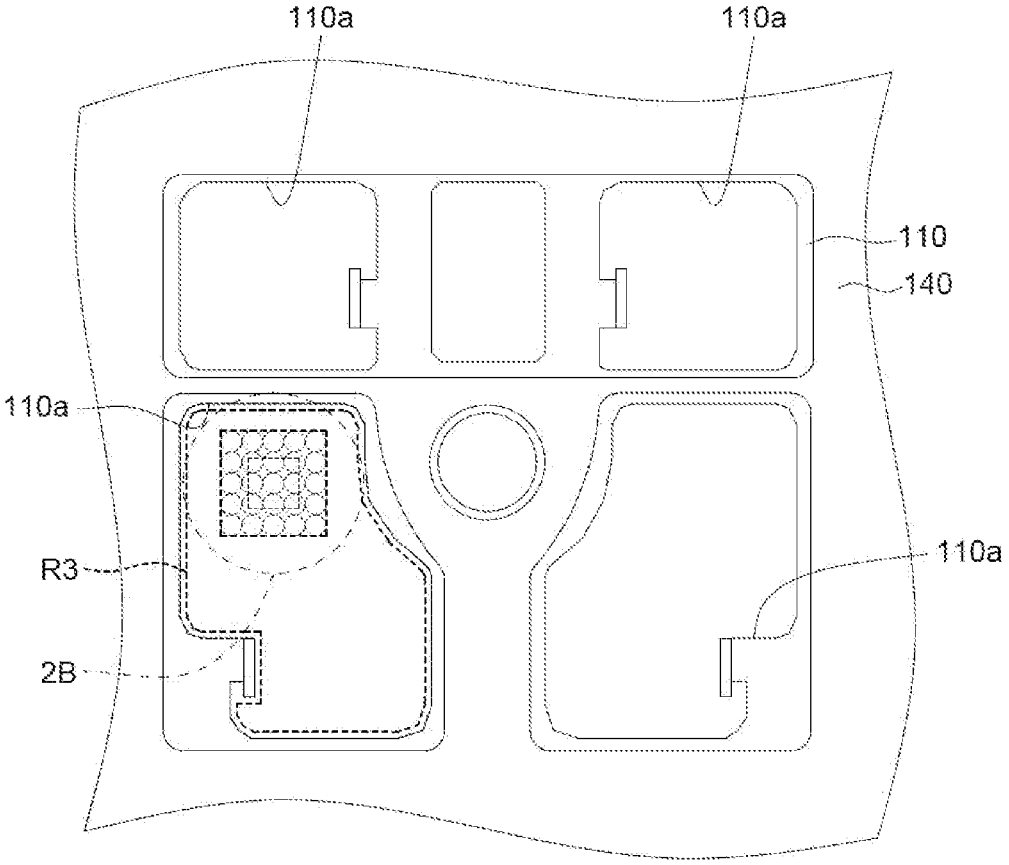
FIG. 2A is a top view of the bottom plate and the thin-film switch layer of FIG. 1.
Figure 2B:
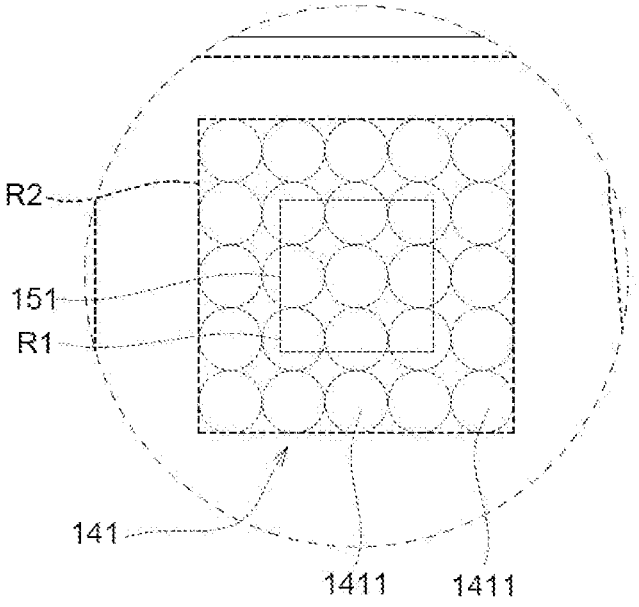
FIG. 2B is an enlarged view of a local portion 2B of FIG. 2A.

Refer to FIGS. 1A-2B, FIG. 1A is a partial cross-sectional view of a key structure 100 according to an embodiment of the present invention, FIG. 1B is an enlarged view of a local portion 1B of FIG. 1A, FIG. 2A is a top view of the bottom plate 110 and the thin-film switch layer 140 of FIG. 1B, and FIG. 2B is an enlarged view of a local portion 2B of FIG. 2A. The key structure 100 includes a bottom plate 110, at least one keycap 120, at least one lifting mechanism 130, an elastomer 135, a thin-film switch layer 140 and a backlight module 150. The key structure 100 can be selectively connected to the keyboard of an electronic device (such as a computer or a home appliance) or integrated with the keyboard of a notebook computer, but the present invention is not limited thereto.

The bottom plate 110 has at least one through hole 110*a*. The lifting mechanism 130 is pivotally connected to the bottom plate 110 and the keycap 120. The thin-film switch layer 140 has at least one reflective structure 141 corresponding to the through hole 110*a*. The backlight module 150 includes at least one light source 151, a reflective layer 152 and a circuit layer 153. The light source 151 is disposed on the circuit layer 153 and configured to emit a light L1 towards the reflective structure 141. The reflective layer 152 is disposed surrounding the light source 151 to reflect a reflected light L1 from the reflective structure 141 to the thin-film switch layer 140.

In the present embodiment, the light source could be realized by a light emitting diode (LED), a mini LED, a micro LED, an organic light emitting diode (OLED) or other light-emitting elements with light-emitting function, but the present invention is not limited thereto.

As shown in FIGS. 1A and 1B, the key structure 100 includes a press key. In a press key unit, a lifting mechanism 130 is pivotally connected to a keycap 120 and the bottom plate 110, and at least one light source 151 corresponds to at least one through hole 110*a*. Although the key structure 100 is exemplified by a press key unit in the present embodiment, the key structure 100 may include a plurality of press key units in another embodiment. The quantity of the light source 151 is exemplified by two in the present embodiment, but could be one or more than two in other embodiments. In the present embodiment, the light source 151 is within the orthographic projection range of the keycap 120, and the light source 151 and the elastomer 135 do not overlap along the orthographic direction. Here, the orthographic direction refers to the lifting direction of the keycap 120.

Through the design of the reflective structure 141, the light L1 emitted from the light source 151 is firstly reflected or diffused between the reflective structure 141 and the backlight module 150 for several times and then passes through the thin-film switch layer 140 to reach the keycap 120. Thus, the emission angle A1 of the light L1 emitted from the thin-film switch layer 140 could be increased.

Since the emission angle A1 of the light L1 emitted from the thin-film switch layer 140 is increased, the uniformity of distribution of the light L1 emitted from the keycap 120 and/or the irradiation area of the keycap 120 still could be increased even when the light sources 151 are spaced by a larger interval. As shown in FIGS. 1B and 2B, each of the light sources 151 has a light-emitting surface 151*u*. Since the emission angle A1 of the light L1 emitted from the thin-film switch layer 140 is increased, the uniformity of distribution of the light L1 emitted from the keycap 120 and/or the irradiation range of the keycap still could be increased even when the light-emitting surface 151*u* of the light source 151 has a small light-emitting area R1 (illustrated in FIG. 2B). In an embodiment, the ratio of the distribution area R2 (illustrated in FIG. 2B) of the reflective structure 141 to the light-emitting area R1 of the light-emitting surface 151*u* could be in a range of 50% to 200% or could be outside the said range.

In addition, the light-emitting surface 151*u* and the reflective structure 141 are separated by a distance H1 Despite that the distance H1 is very small, the light L1 emitted from the thin-film switch layer 140 still could be reflected and diffused between the reflective structure 141 and the light-emitting surface 151*u* for several times, and the emission angle A1 of the light L1 emitted from the thin-film switch layer 140 still could be effectively increased.

Moreover, the thin-film switch layer 140 further includes a transmissive part 142 disposed between the reflective structure 141 and the sidewall of the through hole 110*a*. As shown in FIGS. 1B and 2B, the through hole 110*a* of the bottom plate 110 has an opening area R3 (illustrated in FIG. 2B) greater than the distribution area R2 of the reflective structure 141, such that the opening of the through hole 110*a* could cover the transmissive part 142. Thus, the light L1 emitted from the light source 151 could pass through the thin-film switch layer 140 via the transmissive part 142 to reach the keycap 120. In an embodiment, the ratio of the opening area R3 of the through hole 110*a* to the distribution area R2 of the reflective structure 141 is greater than but excludes 100%. For example, the ratio is in a range 100% (excluding the endpoint) to 400% (including the endpoint), or even larger. Thus, it could be assured that the light L1 irradiating on the keycap 120 via the transmissive part 142 has a sufficient amount.

As shown in FIGS. 1A and 1B, the bottom plate 110 includes at least one pivotal connecting portion 111 pivotally connected to the lifting mechanism 130. The bottom plate 110 could be formed of metal or carbon fiber, and the pivotal connecting portion 111 could be formed of metal or plastics.

As shown in FIGS. 1A and 1B, the keycap 120 includes a body 121 and a light shielding layer 122. Here, the material of the body 121 is exemplified by a translucent material. The light shielding layer 122 is coated on a surface of the body 121 and has at least one translucent portion 122*a*. The light L1 emitted from the thin-film switch layer 140 could be outputted via the translucent portion 122*a* (that is, to illuminate the translucent portion 122*a*). The translucent portion 122*a* has a pattern, such as a digital pattern, an alphabetic pattern, a word pattern, a mathematical symbol, or a combination thereof.

As shown in FIGS. 1A and 1B, the lifting mechanism 130, which could be realized by a scissor foot mechanism, could move vertically with respect to the pivotal connecting portion 111 of the bottom plate 110 to drive the keycap 120 to move in the same manner. As shown in FIG. 1A, the Z-axis direction is the lifting direction of the keycap 120, and the XY plane is perpendicular to the Z-axis direction.

As shown in FIGS. 1A and 1B, the elastomer 135 is disposed between the keycap 120 and the thin-film switch layer 140. When the key structure 100 changes to a pressed state from a free state (FIG. 1A), the elastomer 135 is deformed and stores an elastic potential energy. When the key structure 100 in the pressed state is released, the elastomer 135 releases the elastic potential energy which restores the key structure 100 to the free state. When the key structure 100 is in the pressed state, the elastomer 135 activates a circuit switch (not illustrated) of the thin-film switch layer 140, and a processor (not illustrated) electrically connected to the key structure 100 could accordingly perform a corresponding function. In an embodiment, the elastomer 135 could be formed of rubber.

As shown in FIGS. 1A and 1B, the thin-film switch layer 140 includes a first layer 140A, a spacer layer 140B and a second layer 140C, wherein the spacer layer 140B is disposed between the first layer 140A and the second layer 140C, and the first layer 140A is closer to the backlight module 150 than the second layer 140C. In the present embodiment, the reflective structure 141 is formed on the first layer 140A, for example, the bottom surface 140*b* of the first layer 140A. Since the reflective structure 141 is already integrated with the existing thin-film switch layer 140, the overall thickness of the key structure 100 almost does not increase.

In the present embodiment, the reflective structure 141 is integrated with the first layer 140A. In terms of manufacturing process, the reflective structure 141 could be formed on the first layer 140A using an injection molding technology and/or an embossing technology. Then, the first layer 140A including the reflective structure 141 together with the spacer layer 1408 and the second layer 140C form the thin-film switch layer 140. In terms of material, the first layer 140A, the spacer layer 140B and/or the second layer 140C could be formed of polymethylmethacrylate (PMMA), polyethylene terephthalate (PET), polypropylene (PP), cyclo olefin polymer (COP), polycarbonate (PC), polystyrene (PS), polymethyl methacrylate (MS)-styrene or other suitable materials. In terms of size, the thickness T1 of the first layer 140A having the reflective structure 141 formed thereon is greater than the thickness of the first layer 140A not having the reflective structure 141. Also, the thickness T1 of the first layer 140A is greater than both the thickness T3 of the second layer 140C and the thickness T2 of the spacer layer 1408.

As shown in FIGS. 1A and 1B, the light source 151 is disposed on and electrically connected to the circuit layer 153. In the present embodiment, the reflective layer 152 is disposed on the circuit layer 153. The reflective layer 152 not only reflects the light L1 emitted from the reflective structure 141 to the thin-film switch layer 140, but further protects the circuits (not illustrated) disposed on the circuit layer 153. Furthermore, the reflective layer 152 does not cover or shield the light-emitting surface 151*u* of the light source 151, such that the light L1 emitted from the light-emitting surface 151*u* could reach the reflective structure 141 instead of being shielded by the reflective layer 152. Moreover, the reflective layer 152 could be formed of a white ink. In an embodiment, the reflective layer 152 could be an additionally formed reflector and has at least one hole 152*a*. After the reflective layer 152 is formed, the reflective layer 152 is disposed on the circuit layer 153, and the light source 151 is located in the hole 152*a* of the reflective layer 152. In embodiment, the circuit layer 153 could be a circuit board. As shown in FIG. 2B, a set of reflective structure 141 and the light source 151 are located within a through hole 110*a*. In another embodiment, each of at least some of the through holes 110*a* has at least one set of reflective structure 141 and light source 151. Besides, a set of reflective structure 141 and light source 151 could be located at any position of the corresponding through hole 110*a*. The number of sets of reflective structures 141 and light sources 151 and/or the position of the reflective structure 141 and the light source 151 in the through hole 110*a* are not subjected to particular restrictions as long as expected light-emitting effect could be achieved (for example, the light could illuminate the translucent portion 122*a* and/or could be uniformly outputted via the translucent portion 122*a*).

As shown in FIG. 2B, the reflective structure 141 is formed of at least one reflective portion 1411. As shown in FIGS. 1 and 2B, the reflective portions 1411 are realized by protrusions, wherein a recess is formed between every two adjacent protrusions, and a plurality of protrusions and a plurality of recesses form a concave-convex structure. In terms of shape, the contour surface of each of the reflective portions 1411 is formed of a curved surface, such as the surface of a part of a sphere, a cylinder, or an elliptical sphere. Or, the contour surface of each of the reflective portions 1411 is formed of a plane, such as a part of the surface of a polyhedron, wherein the polyhedron is such as a polygonal cone, a polygonal cylinder, or a polyhedron with other geometric shape. In other embodiment, the contour surface of each of the reflective portions 1411 could be formed of a curved surface, a plane, or a combination thereof. The contour surface of each of the reflective portions 1411 is not limited to a particular geometric shape, and any shape would do as long as the shape allows the light to be reflected. In an embodiment as shown in FIG. 2B, the reflective portions 1411 are connected to each other. However, in another embodiment, at least two of the reflective portions 1411 could be separated from each other As shown in FIG. 2B, in the present embodiment, the reflective portions 1411 are distributed in the shape of points. However, in another embodiment, the reflective portions 1411 could be distributed in the shape of strips extended along the direction of a straight line, a curve, or a combination thereof.

Figure 3:
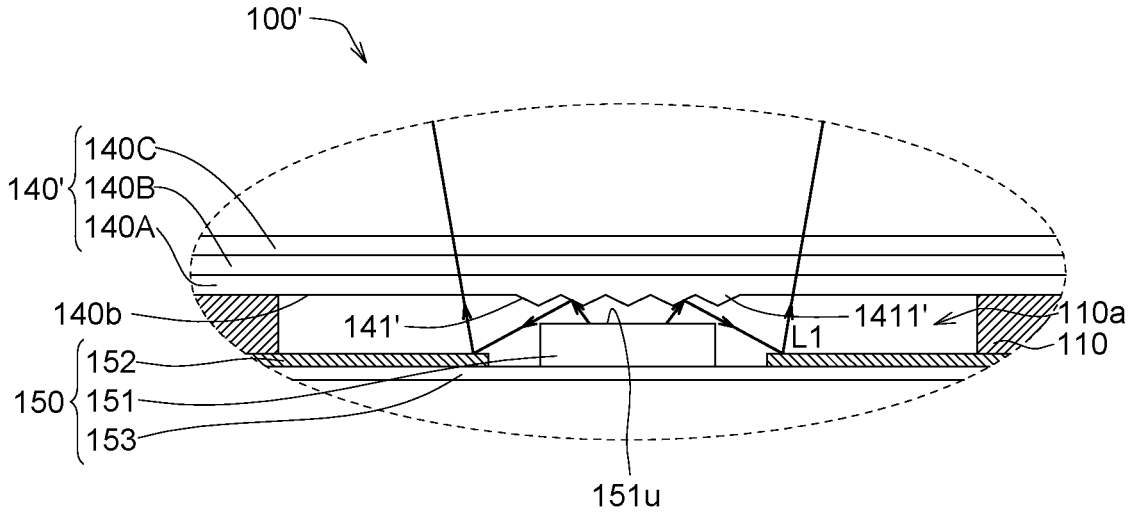
FIG. 3 is a partial cross-sectional view of a key structure according to another embodiment of the present invention.

Referring to FIG. 3, a partial cross-sectional view of a key structure 100' according to another embodiment of the present invention is shown. The key structure 100' includes the bottom plate 110, at least one keycap 120, at least one lifting mechanism 130 (not illustrated), a thin-film switch layer 140' and the backlight module 150. The thin-film switch layer 140' includes at least one reflective structure 141', the first layer 140A, the spacer layer 1408 and the second layer 140C. The reflective structure 141' is formed of at least one reflective portion 1411'. The structure of the key structure 100' of the present embodiment is similar or identical to that of the key structure 100 except that the contour surface of the reflective portion 1411' of the thin-film switch layer 140' is the surface of a triangular cone or cylinder.

Figure 4:
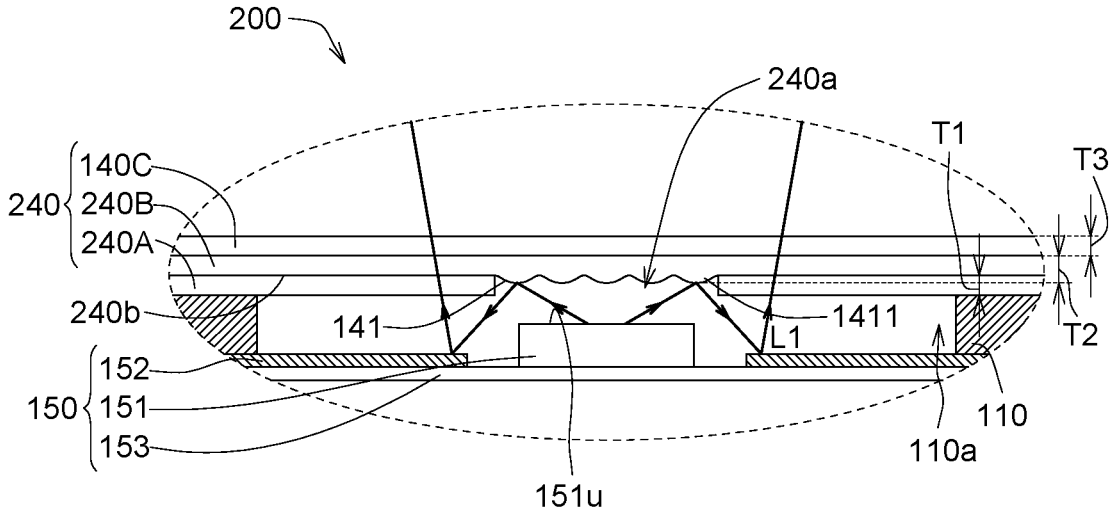
FIG. 4 is a partial cross-sectional view of a key structure according to another embodiment of the present invention.

Referring to FIG. 4, a partial cross-sectional view of a key structure 200 according to another embodiment of the present invention is shown. The key structure 200 includes the bottom plate 110, at least one keycap 120, at least one lifting mechanism 130 (not illustrated), a thin-film switch layer 240 and the backlight module 150. The thin-film switch layer 240 includes the reflective structure 141, a first layer 240A, a spacer layer 240B and the second layer 140C. The structure of the key structure 200 of the present embodiment is similar or identical to that of the key structure 100 except that the reflective structure 141 of the thin-film switch layer 240 is formed on the spacer layer 240B. In another embodiment, the reflective structure 141 of the key structure 200 could be replaced with the reflective structure 141'.

In an embodiment as shown in FIG. 4, the reflective structure 141 is formed on the spacer layer 240B, for example, on the bottom surface 240*b* of the spacer layer 240B; the first layer 240A has at least one first hole 240*a* exposing the reflective structure 141 formed on the spacer layer 240B and allowing the light L1 to reach the reflective structure 141 via the first hole 240*a*. Since the reflective structure 141 is already integrated with the existing thin-film switch layer 240, the overall thickness of the key structure 200 almost does not increase. The manufacturing process of integrating the reflective structure 141 with the spacer layer 240B and forming the reflective structure 141 on the spacer layer 240B is similar or identical to that of forming the reflective structure 141 on the first layer 140A, and the similarities are not repeated here.

In terms of size, the thickness T2 of the spacer layer 240B having the reflective structure 141 formed thereon is greater than the thickness of the spacer layer 240B not having the reflective structure 141. In addition, the thickness T2 of the spacer layer 240B is greater than both the thickness T1 of the first layer 240A and the thickness T3 of the second layer 140C.

Figure 5:
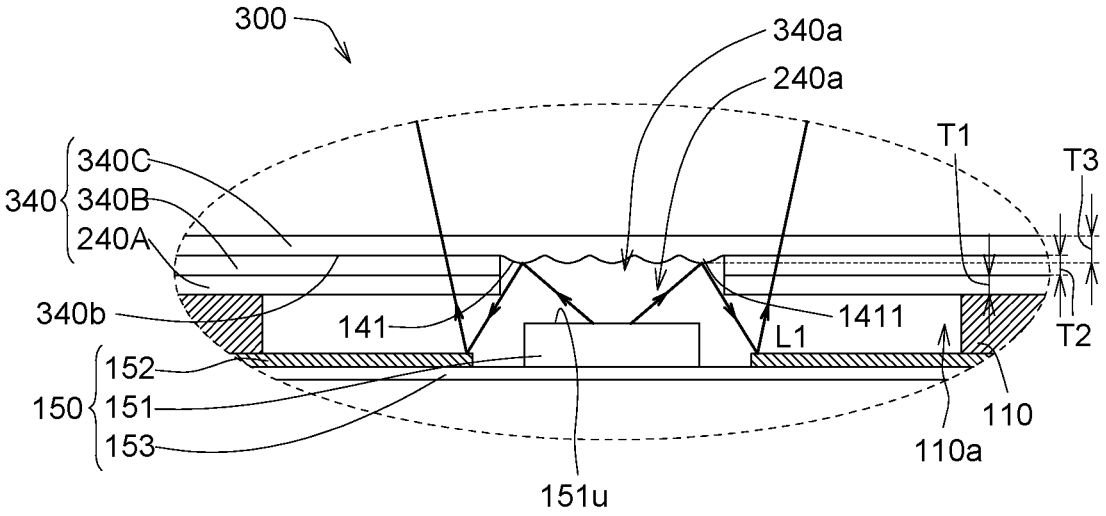
FIG. 5 is a partial cross-sectional view of a key structure according to another embodiment of the present invention.

Referring to FIG. 5, a partial cross-sectional view of a key structure 300 according to another embodiment of the present invention is shown. The key structure 300 includes the bottom plate 110, at least one keycap 120, at least one lifting mechanism 130 (not illustrated), a thin-film switch layer 340 and the backlight module 150. The thin-film switch layer 340 includes a reflective structure 141, the first layer 240A, a spacer layer 340B and a second layer 340C. The structure of the key structure 300 of the present embodiment is similar or identical to that of the key structure 100 except that the reflective structure 141 of the thin-film switch layer 340 is formed on the second layer 340C. In another embodiment, the reflective structure 141 of the key structure 300 could be replaced with the reflective structure 141'.

As shown in FIG. 5, In the present embodiment, the reflective structure 141 is formed on the bottom surface 340*b* of the second layer 340C; the first layer 240A has at least one first hole 240*a*; the spacer layer 340B has at least one second hole 340*a*; the first hole 240*a* and the second hole 340*a* expose the reflective structure 141 formed on the second layer 340C and allow the light L1 to reach the reflective structure 141. Since the reflective structure 141 is already integrated with the existing thin-film switch layer 340, the overall thickness of the key structure 300 almost does not increase. The manufacturing process of integrating the reflective structure 141 with the second layer 340C and forming the reflective structure 141 on the second layer 340C is similar or identical to that of forming the reflective structure 141 on the first layer 140A, and the similarities are not repeated here.

In terms of size, the thickness T3 of the second layer 340C having the reflective structure 141 formed thereon is greater than the thickness of the second layer 340C not having the reflective structure 141. In addition, the thickness T3 of the second layer 340C is greater than both the thickness T1 of the first layer 240A and the thickness T2 of the spacer layer 340B.

Figure 6A:
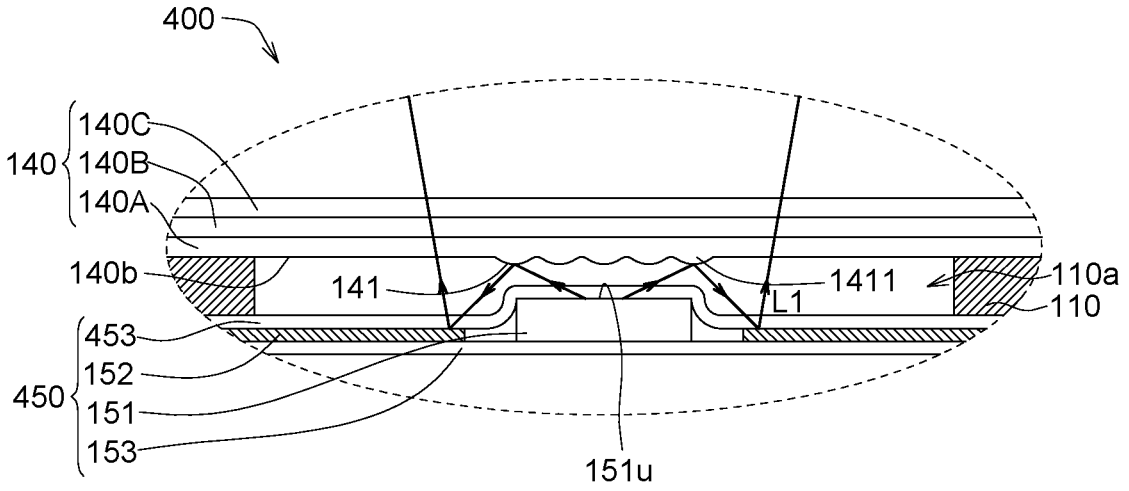
FIG. 6A is a partial cross-sectional view of a key structure according to another embodiment of the present invention.

Referring to FIG. 6A, a partial cross-sectional view of a key structure 400 according to another embodiment of the present invention is shown. The key structure 400 includes the bottom plate 110, at least one keycap 120, at least one lifting mechanism 130 (not illustrated), the thin-film switch layer 140 and a backlight module 450. The structure of the key structure 400 of the present embodiment is similar or identical to that of the key structure 100 except that the structure of the backlight module 450 is different from the backlight module 150 of the key structure 100.

The backlight module 450 includes at least one light source 151, a reflective layer 152, a protection layer 453 and the circuit layer 153. The protection layer 453 is disposed on the light source 151 and the circuit layer 453. In the present embodiment, the protection layer 453 is formed of a translucent material, and covers the light source 151 and the reflective layer 152. Through the above arrangement, the light L1 emitted from the light-emitting surface 151*u* of the light source 151 could pass through the protection layer 453, and could be reflected or diffused between through the reflective structure 141 and the reflective layer 152 for several times. In an embodiment, the protection layer 453 could be an additionally formed protection member which is complete and does not have any holes. After the protection layer 453 is formed, the protection layer 453 is then disposed on the reflective layer 152 and the light source 151.

Figure 6B:
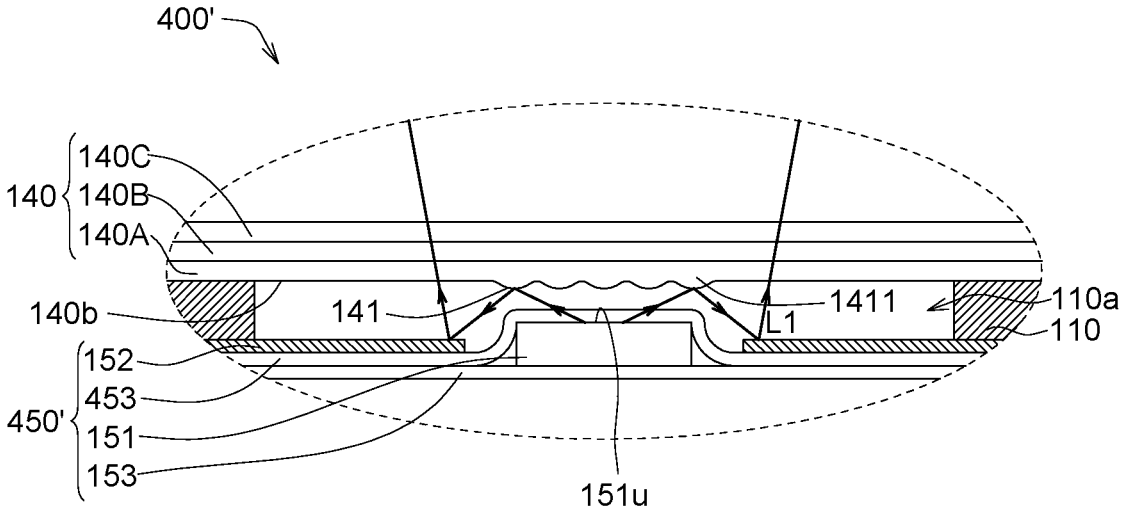
FIG. 6B is a partial cross-sectional view of a key structure according to another embodiment of the present invention.

Referring to FIG. 6B, a partial cross-sectional view of a key structure 400' according to another embodiment of the present invention is shown. The key structure 400' includes the bottom plate 110, at least one keycap 120, at least one lifting mechanism 130 (not illustrated), the thin-film switch layer 140 and a backlight module 450'. The structure of the key structure 400' of the present embodiment is identical or similar to that of the key structure 400 except that the structure of the backlight module 450' is different from the backlight module 450 of the key structure 400.

In the present embodiment, the protection layer 453 of the backlight module 450' of the key structure 400' is firstly disposed on the circuit layer 153 to cover the light source 151, then the reflective layer 152 is disposed on the protection layer 453.

Figure 7A:
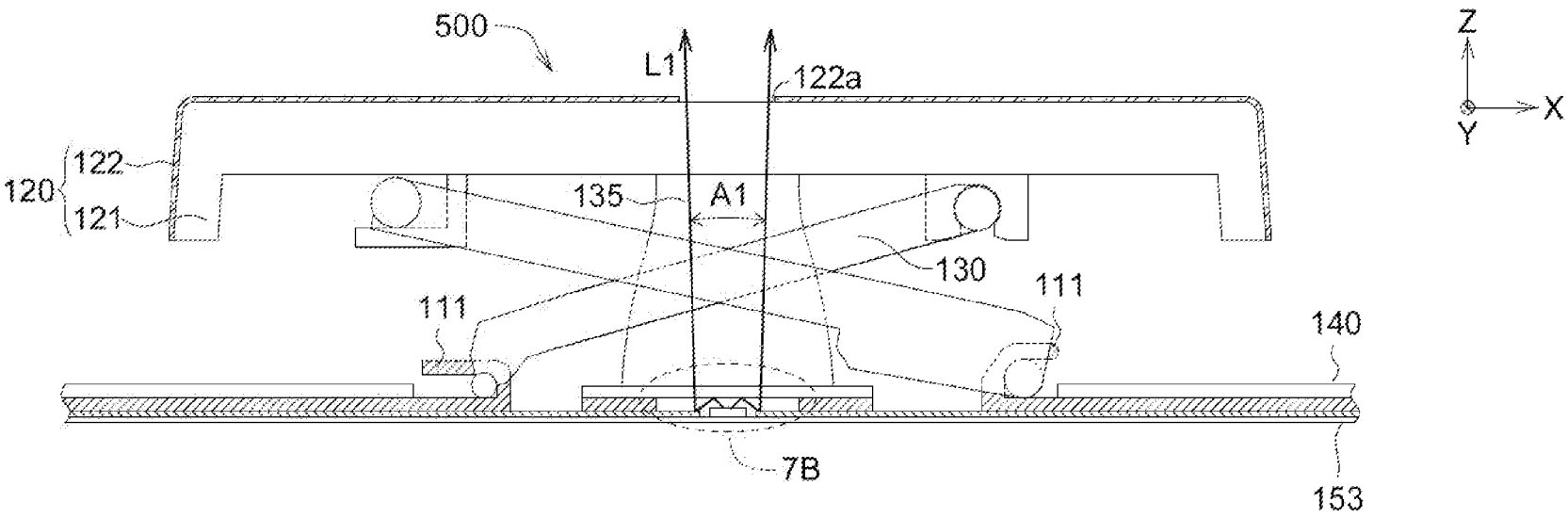
FIG. 7A is a partial cross-sectional view of a key structure according to another embodiment of the present invention.
Figure 7B:
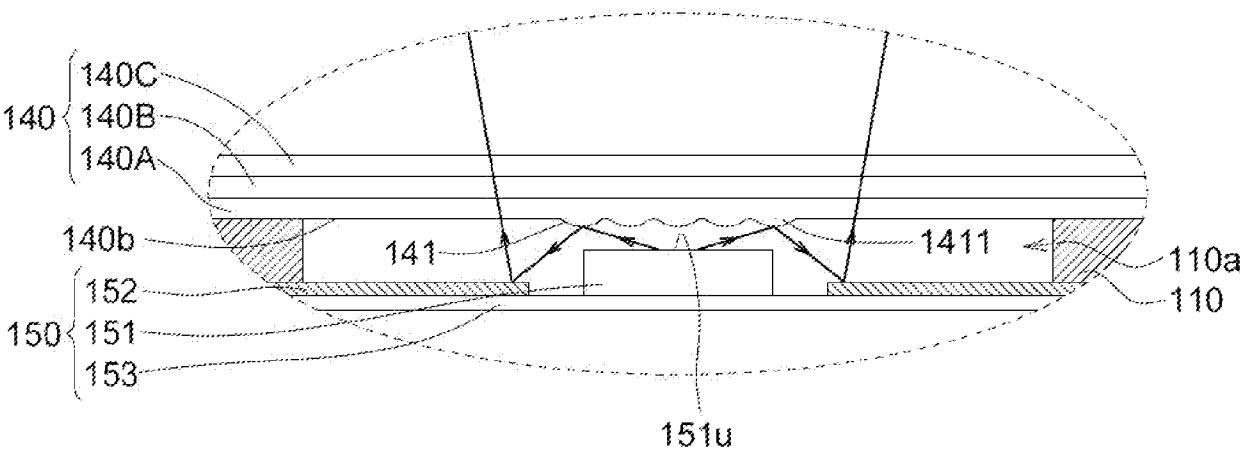
FIG. 7B is an enlarged view of a local portion 7B of FIG. 7A.

Referring to FIGS. 7A and 7B, FIG. 7A is a partial cross-sectional view of a key structure 500 according to another embodiment of the present invention, and FIG. 7B is an enlarged view of a local portion 7B of FIG. 7A. The key structure 500 includes the bottom plate 110, at least one keycap 120, at least one lifting mechanism 130, the thin-film switch layer 140 and the backlight module 150. The key structure 500 of the present embodiment has technical features similar or identical to that of the key structure 100 except that the light source 151 and the reflective structure 141 of the key structure 500 are located under the elastomer 135, such as directly under the elastomer 135. In the present embodiment, the light source 151 and the reflective structure 141 are completely covered by the elastomer 135 along the Z-axis direction. In another embodiment, the light source 151 and the reflective structure 141 could partly displaced with the elastomer 135 along the XY plane Referring to FIGS. 8A(a) and 8A(b), FIG. 8A(a) is a partial cross-sectional view of a key structure 600 according to another embodiment of the present invention, and FIG. 8A(b) is an enlarged view of a local portion 8A(b) of FIG. 8A(a). The key structure 600 includes the bottom plate 110, at least one keycap 120, at least one lifting mechanism 130, a thin-film switch layer 640 and a backlight module 650. The key structure 600 of the present embodiment has technical features similar or identical to that of the key structure 100 except that the structure of the thin-film switch layer 640 is different from that of the thin-film switch layer 140 and that the backlight module 650 further includes a buffer layer 654.

Figure 8A:
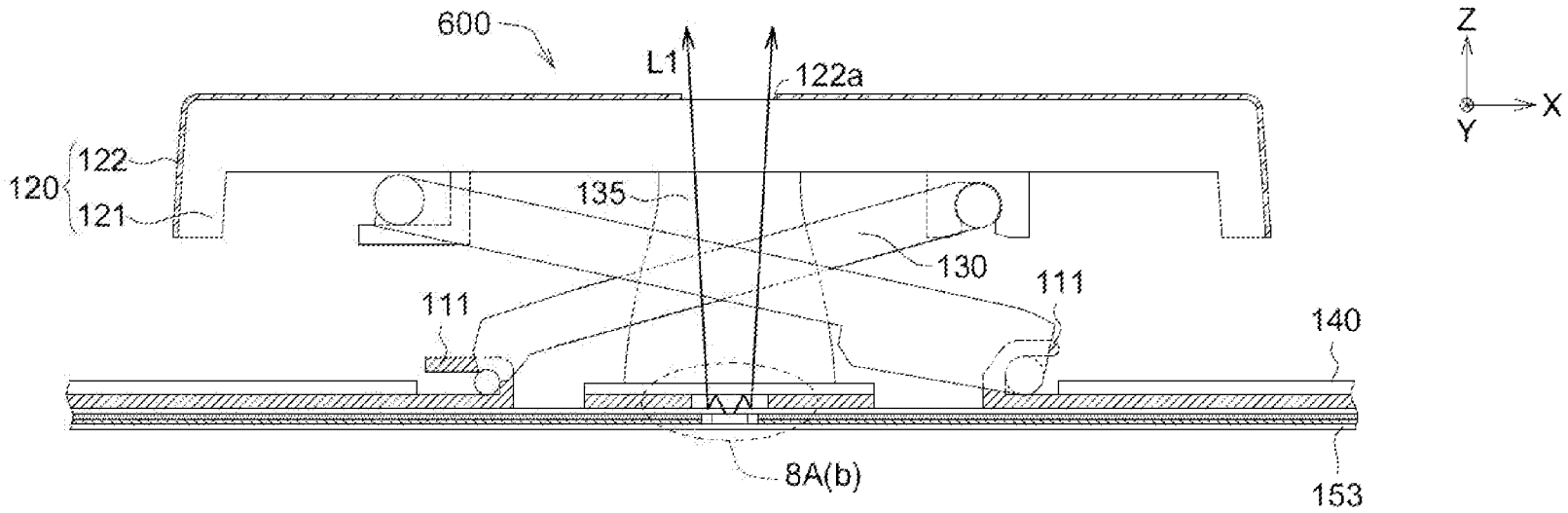
FIGS. 8A(a) to 8E are a partial cross-sectional views of a key structure according to a number of embodiments of the present invention, wherein FIG. 8A(b) is an enlarged view of a local portion 8A(b) of FIG. 8A(a), and FIG. 8B(b) is an enlarged view of a local portion 8B(b) of FIG. 8B(a).
Figure 8A:
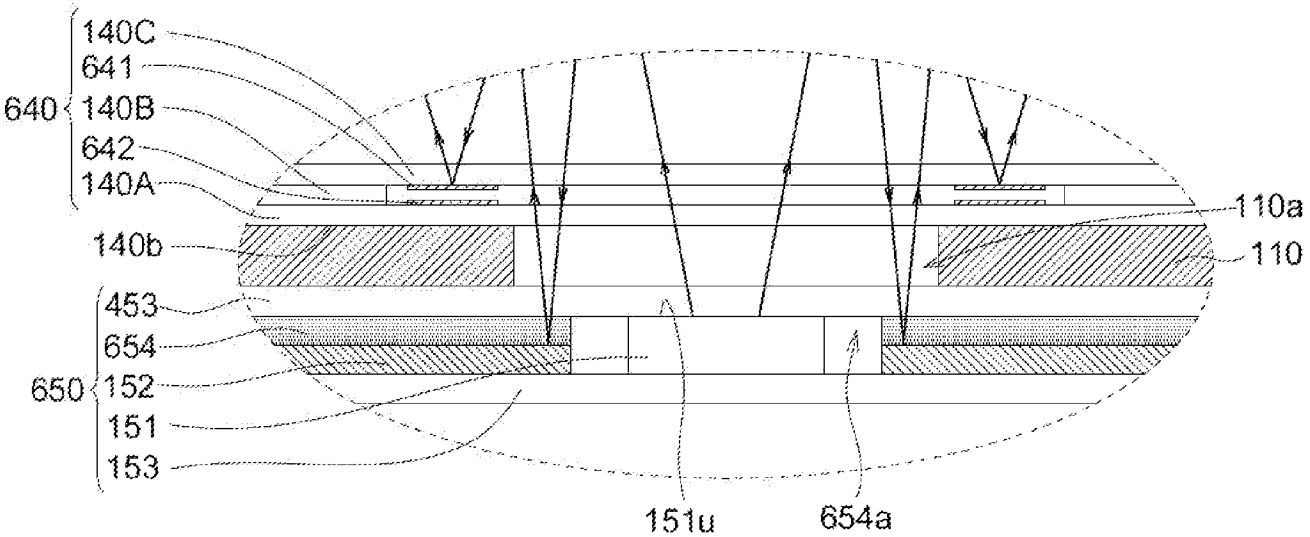

The thin-film switch layer 640 includes the first layer 140A, the spacer layer 140B, the second layer 140C and a reflective structure 641 and 642. The spacer layer 1408 is disposed between the first layer 140A and the second layer 140C, and the first layer 140A is closer to the backlight module 650 than the second layer 140C. In the present embodiment, the reflective structures 641 and 642 are disposed between the first layer 140A and the second layer 140C. For example, the reflective structure 641 is formed on the bottom surface of the second layer 140C, and the reflective structure 642 is formed on the top surface of the first layer 140A. As shown in FIGS. 8A(a) and 8A(b), the light L1 emitted from the light source 151 could pass through the reflective layer 152 and could be reflected or diffused by the reflective structures 641 and/or 642 for several times, such that the emission angle A1 of the light L1 emitted from the thin-film switch layer 140 could be effectively increased, and the light could be uniformly outputted from the keycap 120.

In an embodiment, the reflective structures 641 and/or 642 could be integrated with the conductive layer, such as integrated with at least one trace and/or at least one pad, of the thin-film switch layer 640. For example, the reflective structures 641 and/or 642 are a part of the conductive layer of the thin-film switch layer 640, but the present invention is not limited thereto. Two pads of the conductive layer could respectively be oppositely formed on the top surface of the first layer 140A and the bottom surface of the second layer 140C. When the two pads are activated by the elastomer 135 and become conducted, a conducting signal (not illustrated) is transmitted to a processor (not illustrated) through the pads and traces. In the present embodiment, the reflective structures 641 and/or 642 and the light source 151 do not overlap along the lifting direction of the keycap 120 (not illustrated), but the present invention is not limited thereto.

As shown in FIG. 8A(b), the backlight module 650 includes at least one light source 151, a reflective layer 152, a protection layer 453, the circuit layer 153 and the buffer layer 654. The reflective layer 152 is disposed on the circuit layer 153. The buffer layer 654 is disposed on the reflective layer 152 to increase the height of the protection layer 453 such that the protection layer 453 could be located above the light source 151. The buffer layer 654 could absorb the impact energy caused to the light source 151 by the neighboring elements (such as the thin-film switch layer 640, the bottom plate 110 and so on) to avoid the light source 151 being damaged. In addition, in an embodiment, the buffer layer 654 could be formed of a translucent material, such that the light L1 could pass through the protection layer 453 and the buffer layer 654 to reach the reflective layer 152. Then, the light L1 is further reflected to the keycap 120 from the reflective layer 152.

In addition, the buffer layer 654 is disposed surrounding the light source 151. In an embodiment, the buffer layer 654 could be an additionally formed buffer, and has at least one hole 654*a*. After the buffer layer 654 is formed, the buffer layer 654 is then disposed on the reflective layer 152, and the light source 151 is located in the hole 654*a* of the buffer layer 654.

Figure 8B:
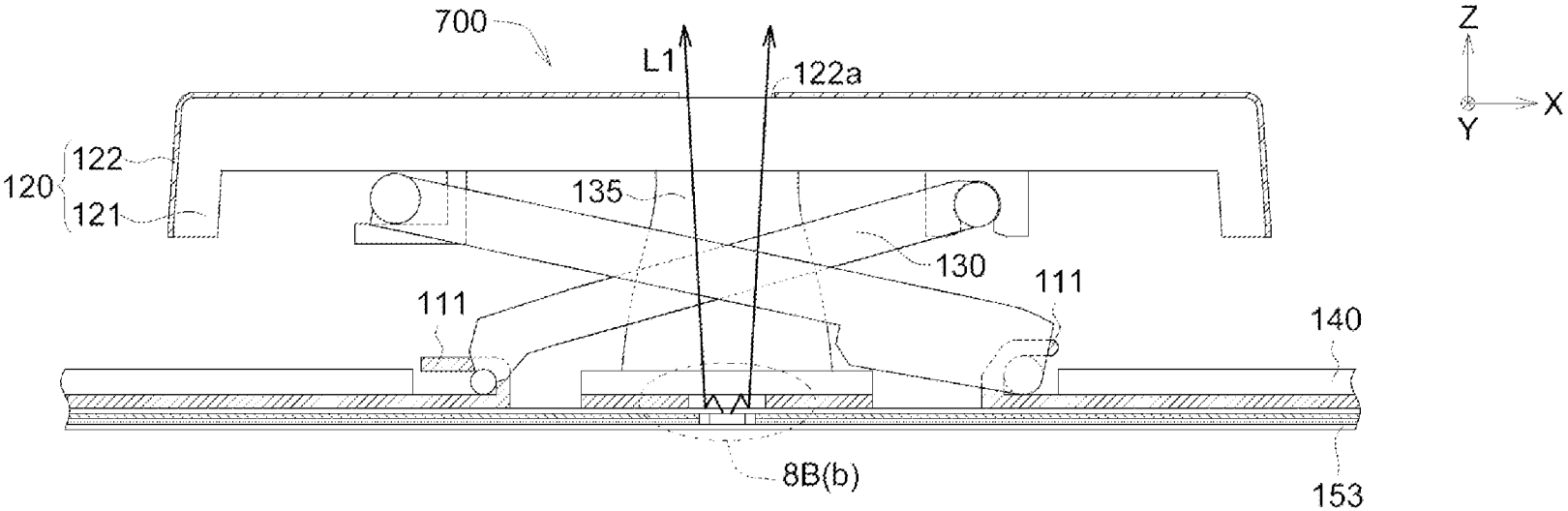
Figure 8B:
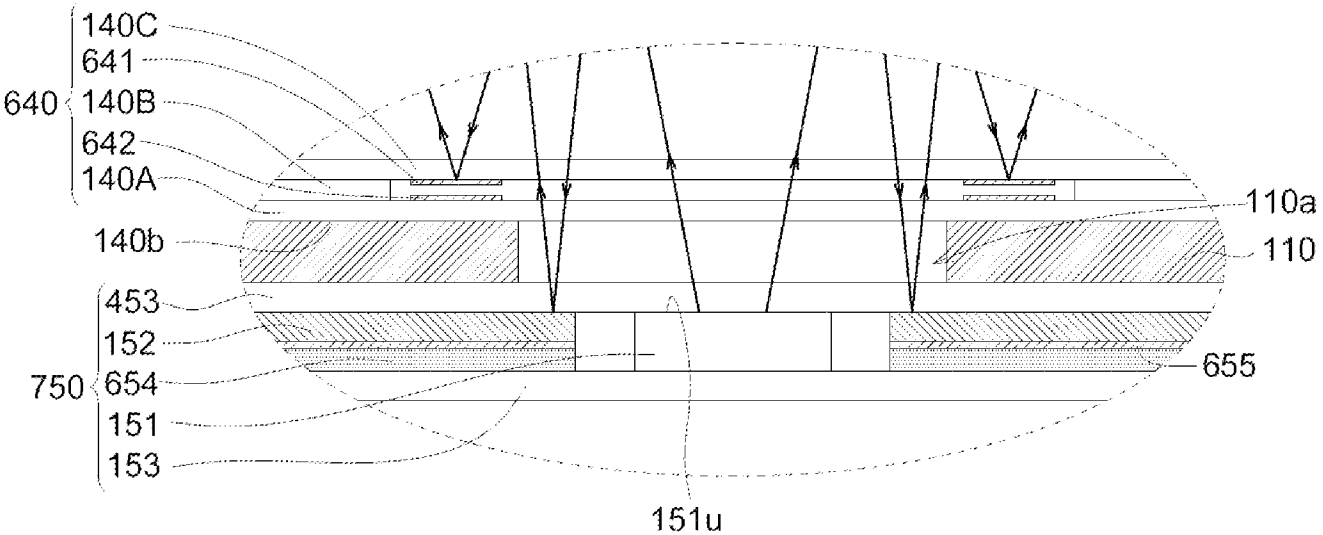

Referring to FIGS. 8B(a) and 8B(b), FIG. 8B (a) is a partial cross-sectional view of a key structure 700 according to another embodiment of the present invention, and FIG. 8B(b) is an enlarged view of a local portion 8B(b) of FIG. 8B(a). The key structure 700 includes the bottom plate 110, at least one keycap 120, at least one lifting mechanism 130, the thin-film switch layer 640 and a backlight module 750. The key structure 700 of the present embodiment has technical features identical or similar to that of the key structure 600 except that the structure of the backlight module 750 is different from that of the backlight module 650. As shown in FIG. 8B(b), in comparison to the backlight module 650, the position of the buffer layer 654 of the backlight module 750 is swapped with that of the reflective layer 152, that is, the buffer layer 654 is disposed on the circuit layer 153. In the present embodiment, the buffer layer 654 could be formed of a non-translucent material (such as black ink) to absorb the light L1. Or, the buffer layer 654 could be formed of a translucent material, and a reflective material 655 could be disposed on its top surface. Or, the reflective layer 152 could be firstly pre-disposed on the buffer layer 654, and then the reflective layer 152 and the buffer layer 654 together are disposed on the circuit layer 153.

Figure 8C:
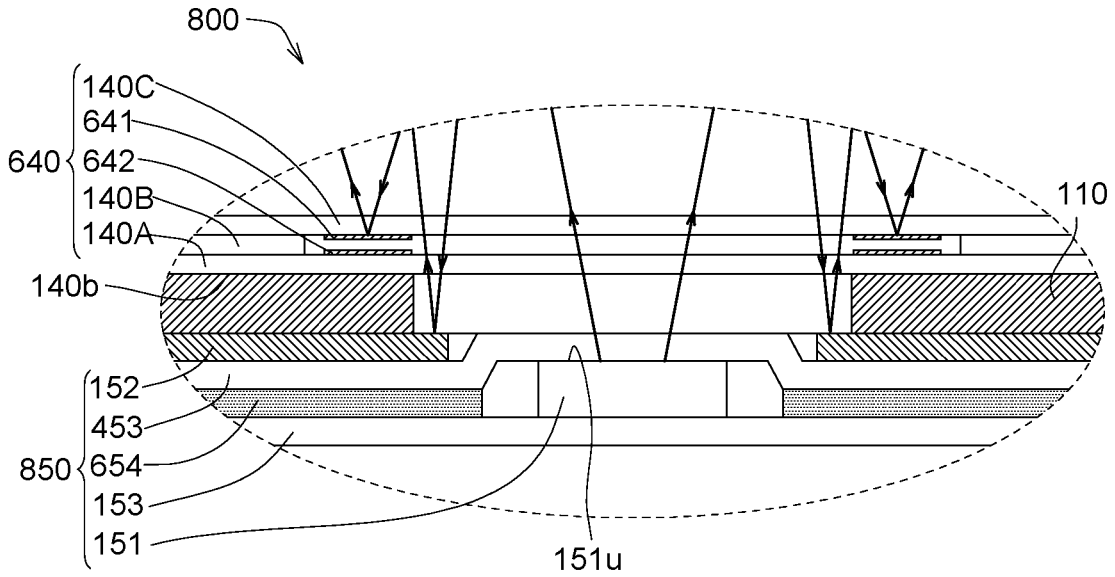

Referring to FIG. 8C, a partial cross-sectional view of a key structure 800 according to another embodiment of the present invention is shown. The key structure 800 includes the bottom plate 110, at least one keycap 120, at least one lifting mechanism 130 (not illustrated), the thin-film switch layer 640 and a backlight module 850. The key structure 800 of the present embodiment has technical features identical or similar to that of the key structure 700 except that the backlight module 850 is different from the backlight module 750. As shown in FIG. 8C, in comparison to the backlight module 750, the position of the reflective layer 152 of the backlight module 850 is swapped with that of the protection layer 453. In the present embodiment, the buffer layer 654 could be formed of a non-translucent material (such as black ink) to absorb the light L1.

Figure 8D:
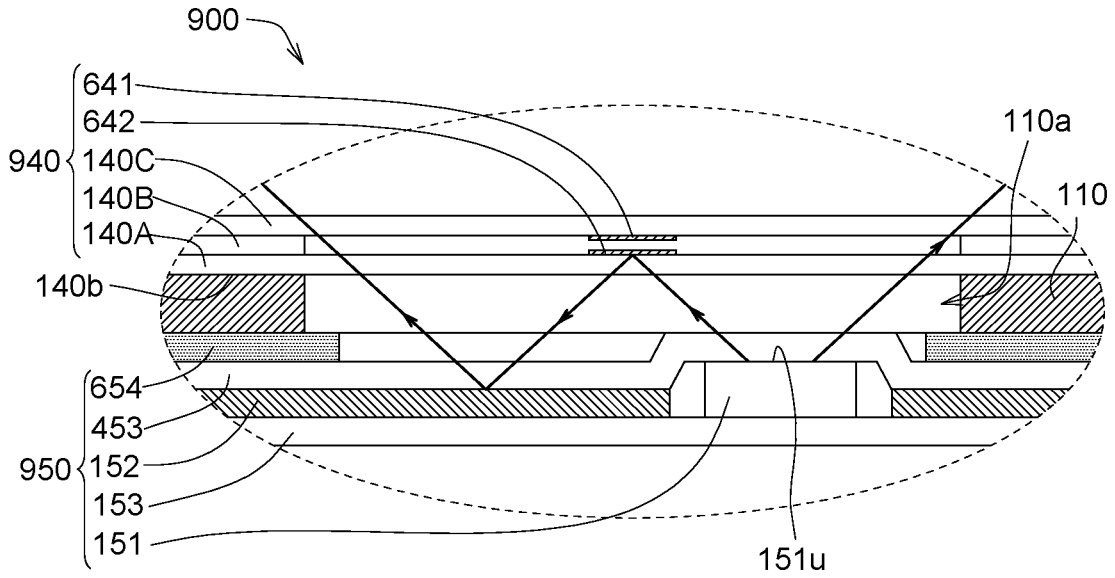

Referring to FIG. 8D, a partial cross-sectional view of a key structure 900 according to another embodiment of the present invention is shown. The key structure 900 includes the bottom plate 110, at least one keycap 120, at least one lifting mechanism 130 (not illustrated), the thin-film switch layer 940 and the backlight module 950. The key structure 900 of the present embodiment has technical features identical or similar to that of the key structure 600 except that the backlight module 950 of the key structure 900 is different from the backlight module 650 and that the thin-film switch layer 940 is different from the thin-film switch layer 640. As shown in FIG. 8D, in comparison to the thin-film switch layer 640, the reflective structures 641 and 642 of the thin-film switch layer 940 are located at the middle of the through hole 110*a* of the bottom plate 110. In comparison to the backlight module 650, the light source 151 of the backlight module 950 and the reflective structure 641 and 642 do not overlap along the lifting direction of the keycap 120 (not illustrated) at all, and the position of the buffer layer 654 of the backlight module 950 is swapped with that of the protection layer 453, that is, the buffer layer 654 is disposed between the protection layer 453 and the bottom plate 110. In the present embodiment, the buffer layer 654 could be formed of a translucent material or a non-translucent material.

Figure 8E:
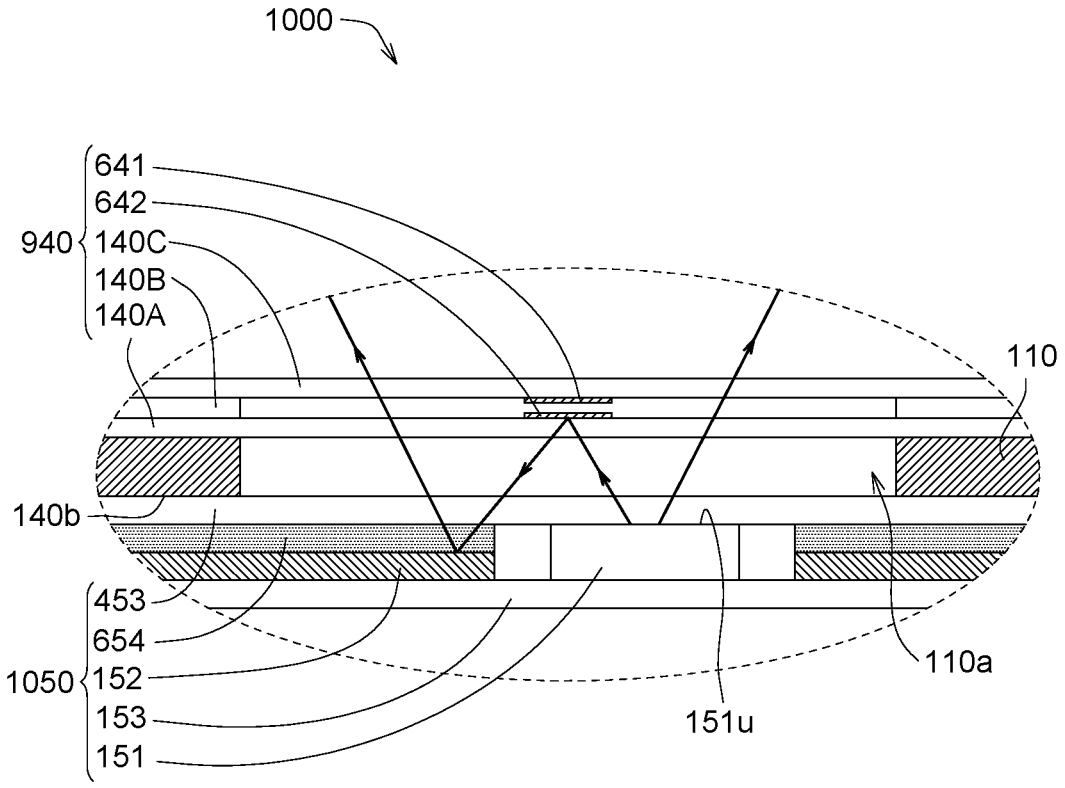

Referring to FIG. 8E, a partial cross-sectional view of a key structure 1000 according to another embodiment of the present invention is shown. The key structure 1000 includes the bottom plate 110, at least one keycap 120, at least one lifting mechanism 130 (not illustrated), a thin-film switch layer 940 and a backlight module 1050. The key structure 1000 of the present embodiment has technical features identical or similar to that of the key structure 900 except that the light source 151 partially overlaps the reflective structures 641 and 642 along the lifting direction of the keycap 120 (not illustrated) and that the position of the buffer layer 654 of the backlight module 950 is swapped with that of the protection layer 453. In the present embodiment, the buffer layer 654 could be formed of a translucent material or a non-translucent material.

To summarize, the key structure of the present invention includes a reflective structure, which is integrated with the thin-film switch layer. The reflective structure could reflect or diffuse the light emitted from the backlight module for several times, such that the emission angle of the light emitted from the thin-film switch layer could be increased, such that the light could be uniformly outputted from the keycap and/or could irradiate a larger area of the keycap.

While the invention has been described by way of example and in terms of the preferred embodiment (s), it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A key structure, comprising:

a bottom plate having a through hole;

a keycap;

a lifting mechanism pivotally connected to the bottom plate and the keycap;

a thin-film switch layer having a reflective structure corresponding to the through hole; and a backlight module, comprising:

a circuit layer;

a light source disposed on the circuit layer and configured to emit light towards the reflective structure; and a reflective layer disposed surrounding the light source to reflect a reflected light from the reflective structure to the thin-film switch layer;

wherein the through hole and the light source overlap along a lifting direction;

wherein the thin-film switch layer comprises:

a first layer;

a second layer; and a spacer layer disposed between the first layer and the second layer;

wherein the reflective structure is formed on the first layer or the second layer;

wherein the first layer or the second layer has a hole exposing the reflective structure.

2. The key structure according to claim 1, wherein the through hole has an opening area, the reflective structure has a distribution area, and the opening area is greater than the distribution area.

3. The key structure according to claim 1, wherein the light source has a light-emitting area, the reflective structure has a distribution area, and the distribution area is greater than the light-emitting area.

4. The key structure according to claim 1, wherein the reflective structure is disposed between the first layer and the second layer.

5. The key structure according to claim 1, wherein the reflective structure is formed on the spacer layer.

6. The key structure according to claim 1, wherein the reflective structure comprises a plurality of reflective portions, and at least two of the reflective portions are connected to each other.

7. The key structure according to claim 1, wherein the reflective structure comprises a plurality of reflective portions, a recess is formed between every two adjacent reflective portions, and the reflective portions and the recesses form a concave-convex structure.

8. The key structure according to claim 1, wherein the light source is within a projection range of the keycap along the lifting direction.

9. A key structure, comprising:

a bottom plate having a through hole;

a keycap;

a lifting mechanism pivotally connected to the bottom plate and the keycap;

a thin-film switch layer having a reflective structure corresponding to the through hole; and a backlight module, comprising:

a circuit layer;

a light source disposed on the circuit layer and configured to emit light towards the reflective structure; and a reflective layer disposed surrounding the light source to reflect a reflected light from the reflective structure to the thin-film switch layer;

wherein the through hole and the light source overlap along a lifting direction;

wherein the reflective structure and the light source do not overlap along the lifting direction of the keycap.

10. The key structure according to claim 9, wherein the thin-film switch layer comprises:

a first layer;

a second layer; and a spacer layer disposed between the first layer and the second layer;

wherein the reflective structure is formed on the first layer or the second layer.

11. The key structure according to claim 10, wherein the reflective structure is disposed between the first layer and the second layer.

12. The key structure according to claim 9, wherein the backlight module further comprises:

a protection layer disposed on the light source and the circuit layer, wherein the reflective layer is disposed on the protection layer or the circuit layer.

13. The key structure according to claim 12, wherein the key structure further comprises:

a buffer layer disposed between the protection layer and the bottom plate.

14. The key structure according to claim 9, wherein the light source is within a projection range of the keycap along the lifting direction.

* * * * *